United States Patent [19]

Nederveld

[11] Patent Number: 4,969,559

[45] Date of Patent: Nov. 13, 1990

[54] PALLETIZED CONTAINER

[75] Inventor: Terrill L. Nederveld, Ada, Mich.

[73] Assignee: Packaging Corporation of America, Evanston, Ill.

[21] Appl. No.: 478,666

[22] Filed: Feb. 12, 1990

[51] Int. Cl.[5] ..... B65D 19/00

[52] U.S. Cl. ..... 206/600

[58] Field of Search ..... 206/600

[56] References Cited

U.S. PATENT DOCUMENTS

| | | | |
|---|---|---|---|
| 3,127,084 | 3/1964 | Williams | 206/600 X |
| 3,291,364 | 12/1966 | Fischer | 206/600 |
| 3,708,861 | 1/1973 | Hickey | 206/600 X |
| 4,373,637 | 2/1983 | Shippell | 206/600 |
| 4,606,461 | 8/1986 | Bolton, Sr. | 206/600 |
| 4,712,687 | 12/1987 | Silcott et al. | 206/600 |
| 4,760,922 | 8/1988 | Northgrave | 206/600 |
| 4,793,507 | 12/1988 | Delplanque | 206/600 X |

*Primary Examiner*—William I. Price

*Attorney, Agent, or Firm*—Neuman, Williams, Anderson & Olson

[57] ABSTRACT

A palletized container is provided which includes a collapsible receptacle section supported and subtended by the upper surface of a pallet section. The receptacle section is adjustable relative to the pallet section between set up and collapsed modes. The receptacle section includes pairs of foldably interconnected outet wall panels. When the receptacle section is in a set up mode, the pairs of wall panels assume upright opposed relation. Each panel of a first pair of wall panels includes a pair of foldably connected panel segments which are adapted to assume a planar relation when the receptacle section is in the set up mode. When the receptacle section is in a collapsed mode, the panel segments of each panel of the first pair assume a folded face-to-face relation and are sandwiched between a second pair of outer wall panels whereby both pairs of outer wall panels overlie the pallet section upper surface. Each panel of the second pair has a flap connected by a foldline to the bottom edge thereof. One of the flaps is affixed to the pallet section upper surface. The edge of each flap opposite the foldline interfit with one another and restrain lateral relative movement therebetween, thereby maintaining the receptacle section in the set up mode.

8 Claims, 2 Drawing Sheets

PALLETIZED CONTAINER

BACKGROUND OF THE INVENTION

The utilization of palletized containers for transporting a wide variety of products between various locations has become increasingly popular because of convenience and cost savings. Such containers, however, have been beset with one or more of the following shortcomings: (a) the container is difficult to set up and/or collapse and requires the talents of skilled personnel; (b) when in a collapsed mode, the container is bulky and occupies an inordinate amount of space; (c) the container incorporates a plurality of component parts; and (d) the container is not readily reusable.

SUMMARY OF THE INVENTION

Thus, an improved palletized container has been provided which avoids all of the aforenoted shortcomings.

The improved container is of simple, light weight, yet sturdy construction, is capable of accommodating a wide variety of products and may be readily reused.

The improved container may be readily set up and collapsed with a minimum amount of manual effort and without the need for tools.

The improved container may be readily stacked with like containers when in either the set up or collapsed mode.

Further and additional advantages possessed by the improved palletized container will become apparent from the description, accompanying drawings and appended claims.

DESCRIPTION

For a more complete understanding of the invention, reference is made to the drawings wherein.

Figure 1:
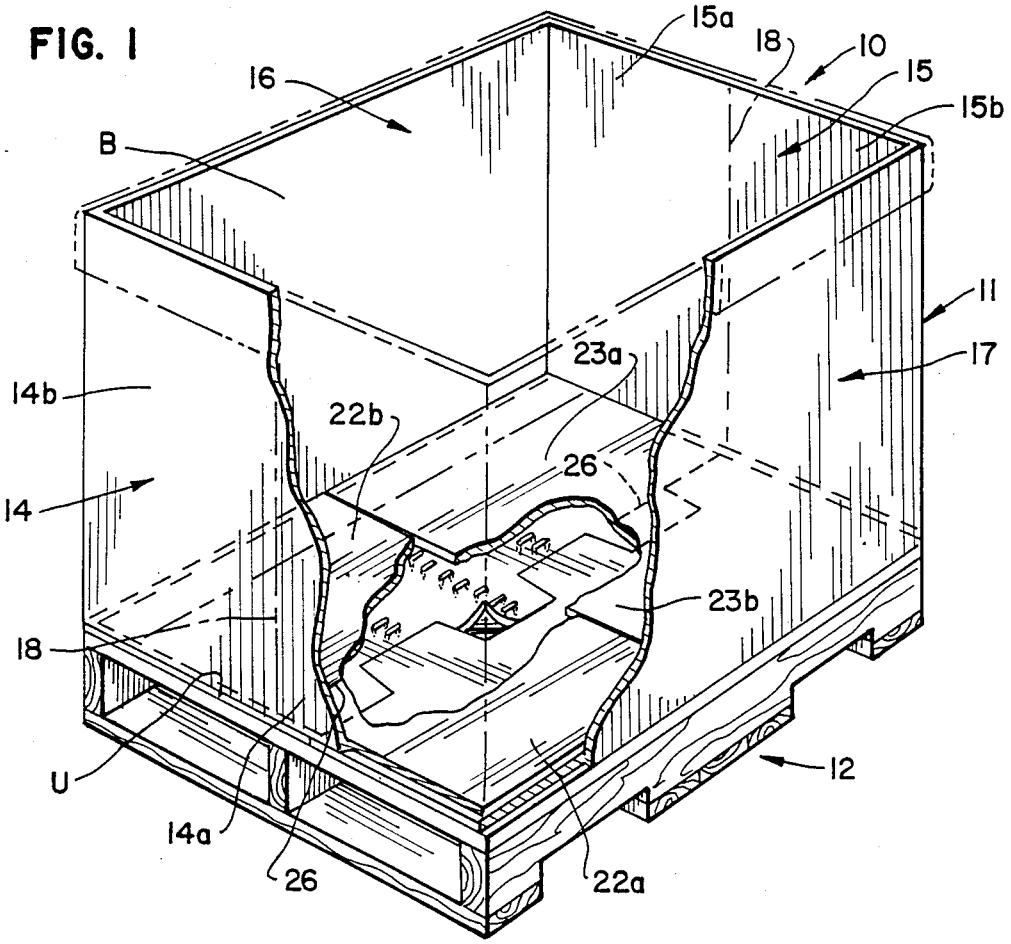
FIG. 1 is a top perspective view of one embodiment of the improved palletized container showing the receptacle section thereof in a substantially set up mode with portions of the outer wall panels removed so as to expose the interfitting of the flaps connected to certain of the panels.

Referring now to the drawings and more particularly to FIG. 1, a preferred embodiment of the improved palletized reusable container 10 is shown in which is adapted to accommodate, when in a set up mode, a variety of products in bulk form (i.e, melons, engine components, detergents, etc.). The size and shape of the container may vary from that shown and will depend upon the size, shape, quantity and gross weight of the accommodated product.

Container 10 comprises two basic components; namely, a collapsible receptacle section 11 and a pallet section 12, the latter being of conventional wooden construction. Receptacle section 11 is preferably formed from a single blank 13, normally of double-faced or double-wall corrugated fiberboard. The fiberboard may be treated so as to be moisture resistant. Container 10 includes a first pair of oppositely disposed outer wall panels 14,15 which are of like configuration, and a second pair of oppositely disposed outer wall panels 16,17 of like configuration. The pairs are foldably interconnected and, when the receptacle section is in a set up mode, the first pair of wall panels 14,15 are arranged in upright spaced parallel relation and the second pair of wall panels 16,17 are arranged in upright spaced parallel relation but at right angles to the first pair of panels. When so arranged, the wall panels cooperate with one another and the upper surface U of the pallet section 12 to form a bin B in which the product is accommodated.

Figure 2:
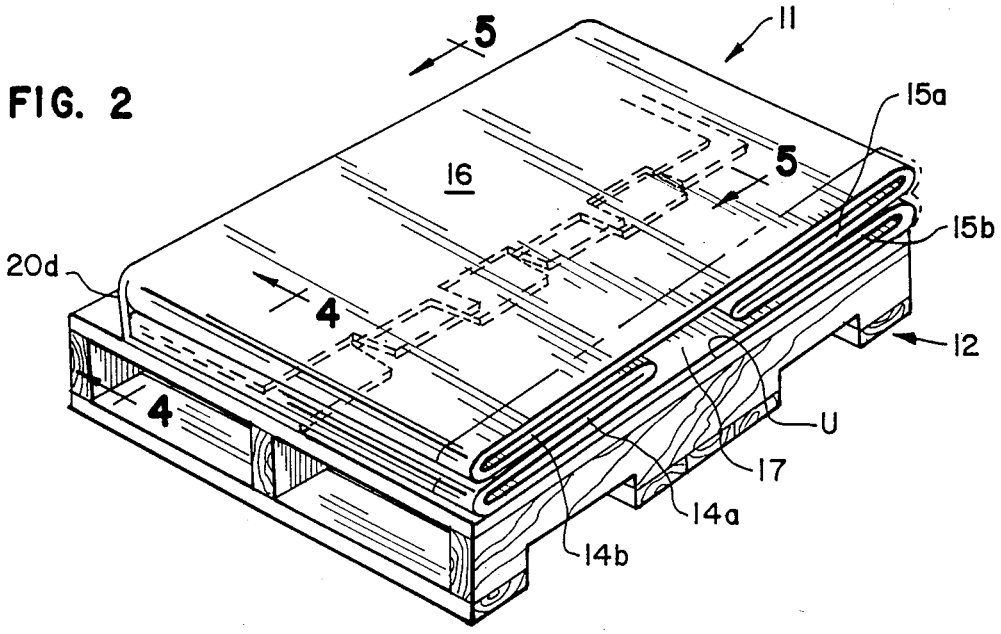
FIG. 2 is similar to FIG. 1 but showing the receptacle section thereof in a collapsed mode.
Figure 3:
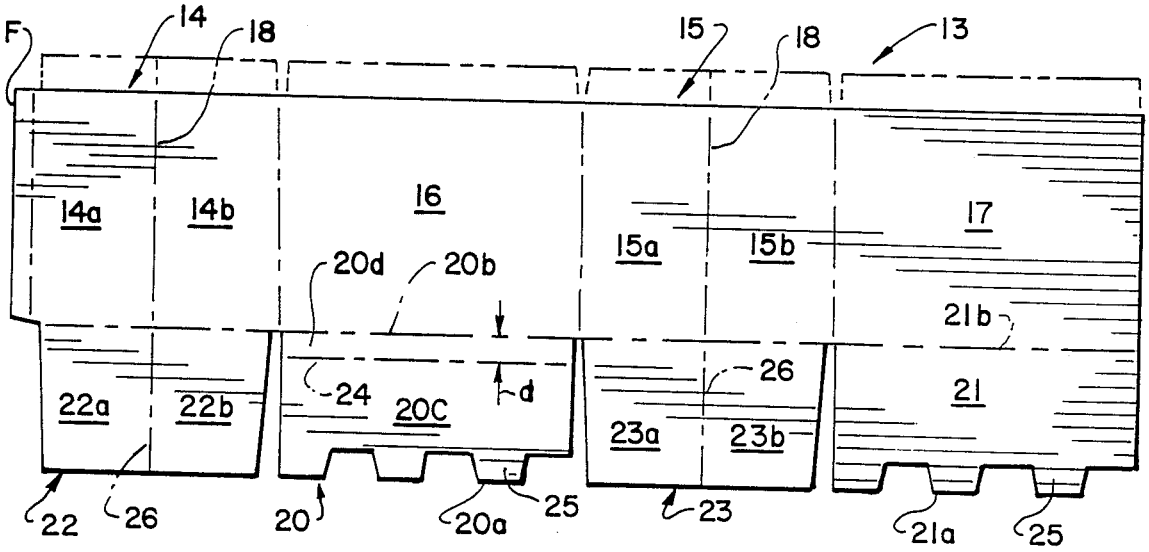
FIG. 3 is a top plan view of a blank for the receptacle section shown in FIG. 1.
Figure 4:
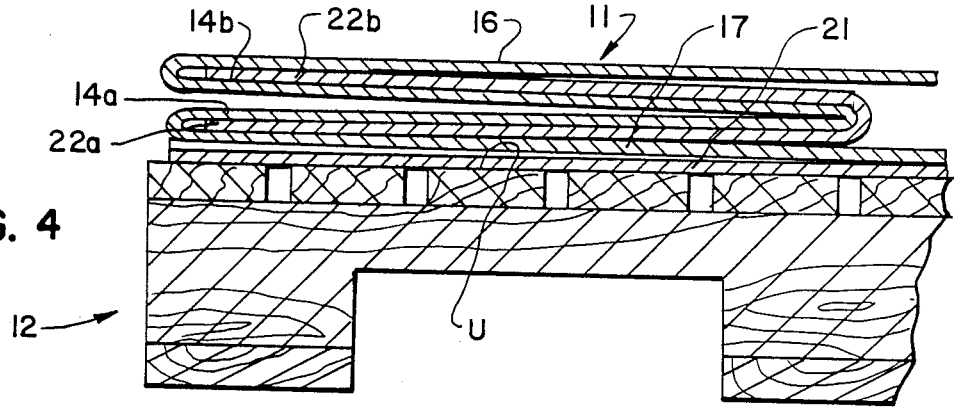
FIG. 4 is an enlarged, fragmentary sectional view taken along line 4—4 of FIG. 2.
Figure 5:
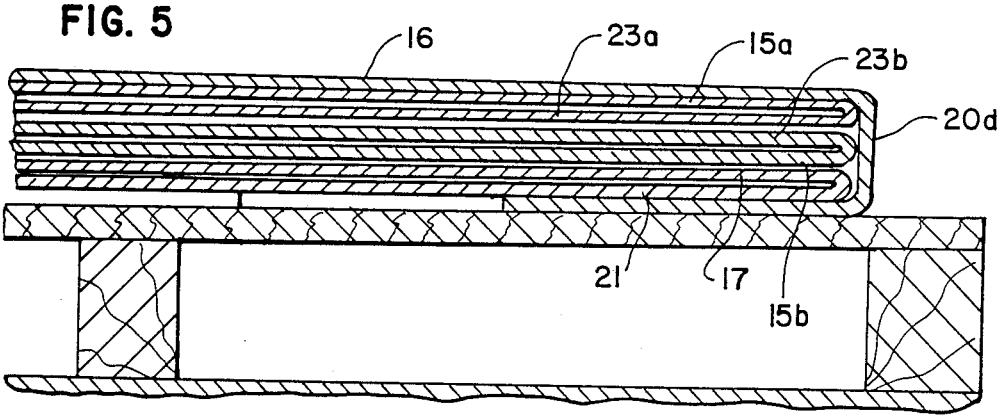
FIG. 5 is an enlarged, fragmentary sectional view taken along line 5—5 of FIG. 2.

As seen in FIGS. 1 and 3, each panel 14,15 is of like configuration and includes a pair of panel segments or subpanels 14*a*–14*b*, 15*a*–15*b* which are interconnected by a common centrally disposed foldline 18. When the receptacle section 11 is in the set up mode, the panel segments for each outer wall panel 14,15 assume a planar relation, see FIG. 1. On the other hand, when the receptacle section 11 is in the collapsed mode, the panel segments of each panel 14,15 are folded inwardly towards the center of the bin B causing the panels to assume a face-to-face relation, see FIG. 2. The disposition of the panel segments 14*a*–14*b*, 15*a*–15*b* relative to the other outer wall panels 16 and 17, when the receptacle section is in the collapsed mode, will be described more fully hereinafter.

Blank 13, as seen in FIG. 3, has the pairs of panel segments 14*a*–14*b*, 15*a*–15*b* separated from one another by panel 16. The remaining wall panel 17 is foldably connected to the opposite side of either panel 14 or 15. A manufacturer's glue flap F may be foldably connected to the outer edge of either panel 14 or 17. Panels 16,17 have the same configuration and remain planar when the receptacle section is in either the set up or collapsed mode. The bottom edges of panels 16 and 17 have foldably connected thereto flaps 20,21 respectively. In a similar manner the bottom edges of panels 14 and 15 have foldably connected thereto flaps 22,23, respectively.

Each flap 20,21 has an inner edge 20*a*,21*a* which is opposite an outer edge 20*b*,21*b*, the latter being foldably connected to the bottom edge of the corresponding panel 16,17. Flap 20 is provided with a foldline 24 which is spaced from and substantially parallel to flap edge 20*b*. Thus, by reason of foldline 24, flap 20 has an inner section 20*c* and a narrow outer section 20*d*. Inner section 20*c* is fixedly secured to the upper surface U of the pallet section 12 when the receptacle section 11 is assembled thereon. When flap inner section 20*c* is secured to the pallet section upper surface, the outer edge 20*b* of the flap 20 should be in registry with a side edge of the pallet surface U, see FIG. 1.

The inner edge 20*a*,21*a* of each flap 20,21 is provided with a plurality of laterally spaced protuberances or teeth 25. The protuberances are sized and shaped so that, when the receptacle section 11 is in the set up mode, see FIG. 1, the protuberances of the flaps 20,21 will intermesh with one another, thus preventing lateral relative movement between the flaps.

Flaps 22,23, which are foldably connected to wall panels 14 and 15, respectively are adapted to overlie the intermeshing flaps 20,21, when the receptacle section is in the set up mode. Each flap 22,23 is provided with a foldline 26 in endwise alignment with foldline 18 provided in the corresponding wall panel 14,15. Foldline 26 allows each flap 22,23 to be formed into flap segments 22*a*–22*b* and 23*a*–23*b* which assume a folded position corresponding to that of panel segments 14*a*–14*b*, 15a–15b when the receptacle section 11 is in the collapsed mode, see FIG. 2.

When the receptacle section 11 is in the set up mode, FIG. 1, the panel segments 14a–14b, 15a–15b of each flap 14,15 are retained in a planar relation by the flaps 22,23 when they are in overlying relation with respect to intermeshing flaps 20,21.

When the receptacle section 11 is to be adjusted from a set up mode, FIG. 1, to a collapsed mode, FIG. 2, the flaps 22,23 are first folded upwardly so as to engage in face-to-face relation the interior surfaces of the upright wall panels 14,15. The bin B is then pivoted upwardly about edge 20b allowing flap 21 to be disengaged from the flap 20, the latter having been previously affixed to the pallet upper surface U, and then swung outwardly until it is in face-to-face engagement with the exterior surface of wall panel 17. Once the flaps 22,23 are in face-to-face engagement with the interior surface of wall panels 14,15 and flap 21 is in face-to-face engagement with panel 17, the wall panels 14 and 15 may be simultaneously pushed inwardly towards one another causing the panel segments 14a–14b and 15a–15b and respective segments 22a–22b and 23a–23b of flaps 22 and 23 to fold relative to one another into face-to-face relation. When this occurs wall panel 17 and folded flap 21 will automatically move towards wall panel 16 resulting in the folded panel segments and respective flap segments to be sandwiched between wall panels 16 and 17. The wall panels 16 and 17 and the panel and flap segments sandwiched therebetween and flap 21 may be folded as a unit about foldline 24 so as to overlie the pallet upper surface U.

In order that the panels and panel segments can properly assume a face-to-face contacting relation when the receptacle is in a collapsed mode, and thus form a flat compact unit, see FIG. 2, it is necessary that the dimension d of the outer flap section 20d measured between edge 20b and foldline 24 be such that it will at least equal the combined thicknesses of the folded panel segments 14a–14b or 15a–15b, flap segments 22a–22b or 23a–23b and flap 21. Thus, the thinner the blank material the shorter will be the dimension d of the outer flap section 20d. Once the set up container has been unloaded, it may be readily collapsed manually without the need for a tool, and returned to the shipper for reloading or storage. When stored in the collapsed mode, several collapsed units may be stacked on top of one another without requiring an inordinate amount of storage space.

The configuration and number of protuberances 25 formed on the inner edges 20a and 21a of flaps 20 and 21 may vary from that shown without departing from the scope of the claimed invention. Flap inner section 20c may be affixed to the pallet upper surface U by a suitable adhesive, staples, nails or the like. Furthermore, the outer wall panels may be provided with conventional top closure flaps or with reinforcing flaps, shown in phantom lines in FIGS. 1 and 3 which may be folded over so as to overlie the upper exterior surfaces of the outer wall panels and be interconnected with one another to reinforce the upper edge of receptacle section when the latter is in the set up mode. If desired, the open top of the bin B may be closed by a separate, conventional telescoping cover, not shown. The cover may be dimensioned to overlie the receptacle section when the latter is in the collapsed mode.

I claim:

1. A palletized container comprising a collapsible receptacle section supported and subtended by an upper surface of a pallet section; said receptacle section including a plurality of foldably interconnected pairs of outer wall panels adapted to extend upright from the pallet section upper surface when said receptacle section is in a set up mode, a first pair of outer wall panels being disposed in opposed relation, each panel of said first pair being provided with a pair of complemental panel segments foldably interconnected and adapted to assume a substantially planar relation when said receptacle section is in the set up mode, and to assume a folded substantially face-to-face relation and sandwiched between a second pair of outer wall panels when said receptacle section is in a collapsed mode and overling said pallet section upper surface, each panel of the second pair being provided with a flap having an outer edge connected by a first foldline to a bottom-forming edge of the second pair panel, means for fixedly securing one of said flaps to the pallet section upper surface whereby the first foldline thereof is adjacent a peripheral segment of the pallet section upper surface, said flaps having inner edges provided with means whereby said inner edges interfit with one another and restrain relative lateral movement between said flaps when the receptable section is in a set up mode.

2. The palletized container of claim 1 wherein the inner edge of one flap is provided with at least one protuberance and the inner edge of the other flap is provided with a recess in which said one protuberance interfits when said receptacle section is in the set up mode.

3. The palletized container of claim 1 wherein the flap fixedly secured to the pallet section upper surface is provided with a second foldline spaced from and substantially parallel to the first foldline thereof; only the portion of the said one flap disposed intermediate said second foldline and the inner edge being fixedly secured to said pallet section upper surface.

4. The palletized container of claim 3 wherein the spacing between the first and second foldlines is substantially equal to at least the combined thicknesses of the second pair of outer wall panels and the complemental panel segments of the first pair of outer wall panels when said panel segments are in face-to-face relation and sandwiched between the second pair of wall panels.

5. The palletized container of claim 1 wherein each inner edge of the flaps is provided with a plurality of laterally spaced protuberances whereby the protuberances of one flap intermesh with the protuberances of the other flap when the receptacle section is in the set up mode.

6. The palletized container of claim 1 wherein the first pair of outer wall panels include bottom flaps, each bottom flap including a pair of complemental foldably interconnected flap segments, each flap segment being foldably connected to a corresponding panel segment; when the receptacle section is in the setup mode, the flap segments of said bottom flaps are disposed in substantially planar relation and overlying the pallet section upper surface; when the receptacle section is in the collapsed mode, the flap segments are folded in substantially face to face relation and are sandwiched between the second pair of outer wall panels.

7. The palletized container of claim 6 wherein a second of the flaps connected to the second pair of outer wall panels is adapted to assume a folded substantially face to face relation with a surface of the said one outer wall panel when the receptacle section is in a collapsed mode.

8. The palletized container of claim 7 wherein the second flap of the second pair of outer wall panels, when the receptacle section is in the collapsed mode, is sandwiched between the pallet section upper surface and the second pair outer wall panel to which said second flap is foldably connected.

* * * * *